US008837958B2

(12) United States Patent
Kikuchi

(10) Patent No.: US 8,837,958 B2
(45) Date of Patent: Sep. 16, 2014

(54) FUSER INCLUDING REPLACEMENT DETECTING FUNCTION

(71) Applicant: Kazuhiko Kikuchi, Kanagawa (JP)

(72) Inventor: Kazuhiko Kikuchi, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1 day.

(21) Appl. No.: 13/673,235

(22) Filed: Nov. 9, 2012

(65) Prior Publication Data

US 2013/0129362 A1 May 23, 2013

Related U.S. Application Data

(60) Provisional application No. 61/563,010, filed on Nov. 22, 2011, provisional application No. 61/563,013, filed on Nov. 22, 2011.

(51) Int. Cl.
*G03G 15/20* (2006.01)

(52) U.S. Cl.
CPC ..... *G03G 15/205* (2013.01)
USPC ..... 399/12; 399/33

(58) Field of Classification Search
USPC ..... 399/12, 13, 33
See application file for complete search history.

(56) References Cited

U.S. PATENT DOCUMENTS

| | | | | |
|---|---|---|---|---|
| 5,214,481 | A * | 5/1993 | Hoover | 399/335 |
| 6,909,862 | B2 * | 6/2005 | Samei et al. | 399/69 |
| 7,203,439 | B2 | 4/2007 | Sone et al. | |
| 2002/0003966 | A1 * | 1/2002 | Iwaki et al. | 399/12 |
| 2007/0098418 | A1 * | 5/2007 | Kang et al. | 399/33 |
| 2007/0183798 | A1 * | 8/2007 | Moriguchi et al. | 399/33 |
| 2010/0142978 | A1 * | 6/2010 | Hyun et al. | 399/33 |

* cited by examiner

*Primary Examiner* — Walter L Lindsay, Jr.
*Assistant Examiner* — Arlene Heredia Ocasio
(74) *Attorney, Agent, or Firm* — Patterson & Sheridan LLP

(57) ABSTRACT

According to one embodiment, a fuser includes a fixing rotating section including a heat generating section, an opposed section configured to form a nip between the opposed section and the fixing rotating section, a first bimetal type thermostat disconnected by heat from the fixing rotating section to cut power supply to a heat generation source that causes the heat generation section to generate heat, and a second bimetal type thermostat present in a position different from the position of the first bimetal type thermostat in a rotating direction of the fixing rotating section and is disconnected by heat from the fixing rotating section to output an indication that the fixing rotating section is in use.

7 Claims, 7 Drawing Sheets

FUSER INCLUDING REPLACEMENT DETECTING FUNCTION

CROSS-REFERENCE TO RELATED APPLICATION

This application is based upon and claims the benefit of priority from Provisional U.S. Applications 61/563,010 filed on Nov. 22, 2011 and 61/563,013 filed on Nov. 22, 2011 the entire contents of which are incorporated herein by reference.

FIELD

Embodiments described herein relate generally to a fuser mounted on an image forming apparatus and including a detecting function for detecting that a unit is replaced with a new unit.

BACKGROUND

Among image forming apparatuses such as a copying machine and a printer, there is an apparatus in which fuses are provided in various units to detect replacement of an image forming unit with a new image forming unit.

In a temperature fuse of a unit that is disconnected by heating due to first energization to a new unit, if the fuse is once disconnected and reheated and melted, it is likely that the fuse is likely to adhere again. In a current fuse that is disconnected if an electric current equal to or larger than a specified current is fed by first energization to a new unit, it is necessary to provide a blowing-out circuit having a large current capacity in order to disconnect the fuse.

DETAILED DESCRIPTION

In general, according to one embodiment, a fuser includes: a fixing rotating section including a heat generating section; an opposed section configured to form a nip between the opposed section and the fixing rotating section; a first bimetal type thermostat disconnected by heat from the fixing rotating section to cut power supply to a heat generation source that causes the heat generation section to generate heat; and a second bimetal type thermostat present in a position different from the position of the first bimetal type thermostat in a rotating direction of the fixing rotating section and is disconnected by heat from the fixing rotating section to output an indication that the fixing rotating section is in use.

Embodiments are explained below.

[First Embodiment]

Figure 1:
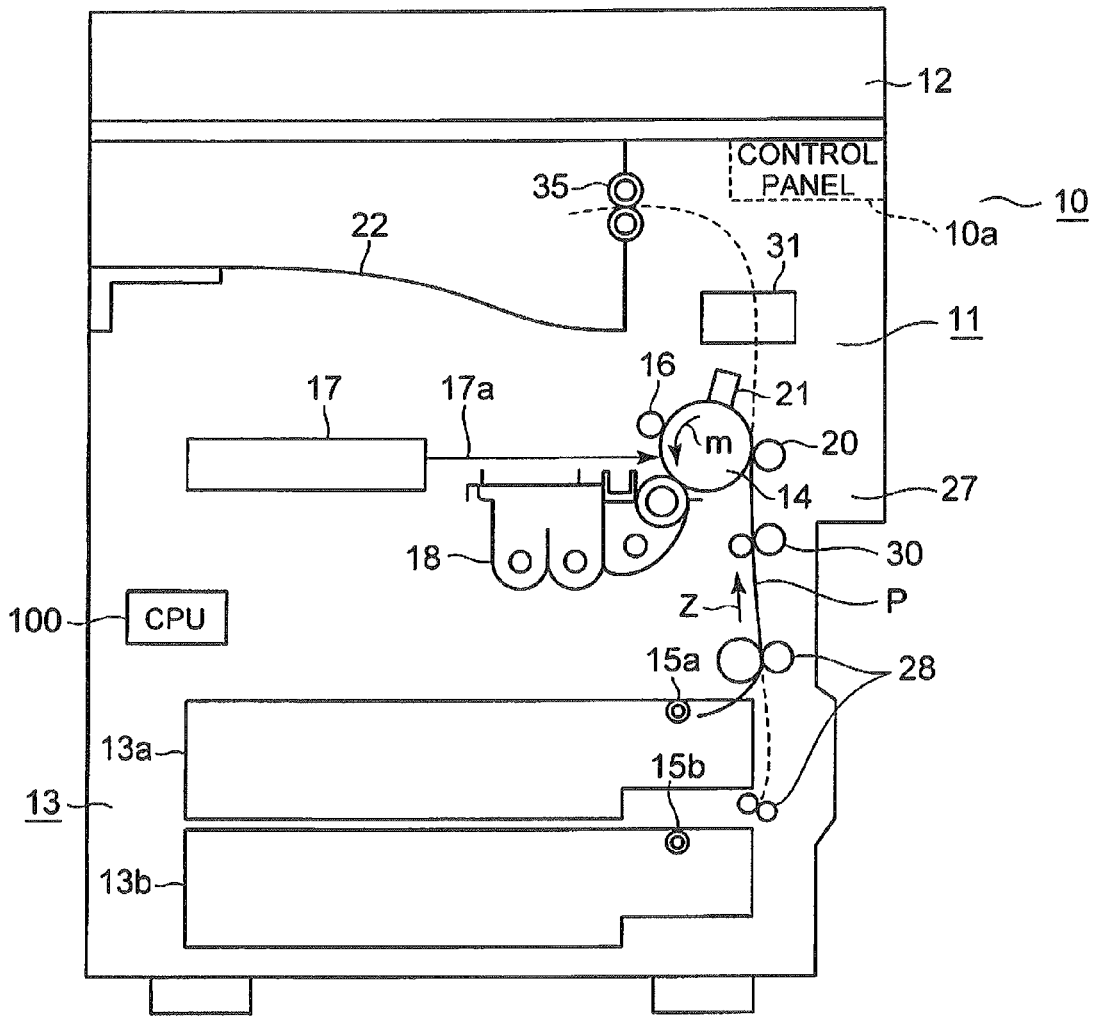
FIG. 1 is a schematic configuration diagram showing an MFP mounted with a fuser unit in a first embodiment.

FIG. 1 is a schematic configuration diagram of a multi functional peripheral (hereinafter abbreviated as MFP) 10, which is an example of an image forming apparatus mounted with a fuser in a first embodiment. The MFP 10 includes a control panel 10*a*, a printer section 11, which is an image forming section, a scanner section 12, a paper feeding section 13, and a paper discharge section 22. The MFP 10 includes a CPU 100, which is a control section configured to control the entire MFP 10.

The paper feeding section 13 includes first and second paper feeding cassettes 13*a* and 13*b* respectively including paper feeding rollers 15*a* and 15*b*. The paper feeding cassettes 13*a* and 13*b* can feed both an unused sheet and a reuse sheet (e.g., a sheet from which an image is erased by decoloring processing).

The printer section 11 includes a charging device 16 configured to uniformly charge a photoconductive drum 14 that rotates in an arrow m direction and a laser exposing device 17 configured to irradiate a laser beam 17*a*, which is based on image data and the like from the scanner section 12, on the charged photoconductive drum 14 and form an electrostatic latent image on the photoconductive drum 14. The printer section 11 includes a developing device 18 configured to supply a toner to the electrostatic latent image on the photoconductive drum 14, a transfer roller 20 configured to transfer a toner image formed on the photoconductive drum 14 onto a sheet P, which is a recording medium, and a cleaner 21.

The developing device 18 supplies the toner to the electrostatic latent image on the photoconductive drum 14 using a two-component developer, which is a mixture of the toner and a magnetic carrier. The MFP 10 includes a fuser unit 31, which is a fuser, between the photoconductive drum 14 and the paper discharge section 22. The MFP 10 includes a conveying path 27 for conveying the sheet P from the paper feeding section 13 to the paper discharge section 22 through the photoconductive drum 14 and the fuser unit 31. The conveying path 27 includes conveying rollers 28, a registration roller pair 30 configured to convey the sheet P to between the photoconductive drum 14 and the transfer roller 20 in synchronization with the toner image on the photoconductive drum 14, and a paper discharge roller 35 configured to discharge the sheet P to the paper discharge section 22 after the toner image is fixed on the sheet P.

With these components, the MFP 10 transfers the toner image formed by the printer section 11 onto the sheet P fed from the paper feeding section 13. After fixing the toner image on the sheet P with the fuser unit 31, the MFP 10 discharges the sheet P, on which a print is completed, to the paper discharge section 22. The image forming apparatus is not limited to the MFP 10 explained above. The image forming apparatus may be an image forming apparatus including a plurality of printer sections. The image forming apparatus may be an image forming apparatus that forms an image using, for example, a decolorable toner that can be decolored by being heated at a predetermined temperature.

Figure 2:
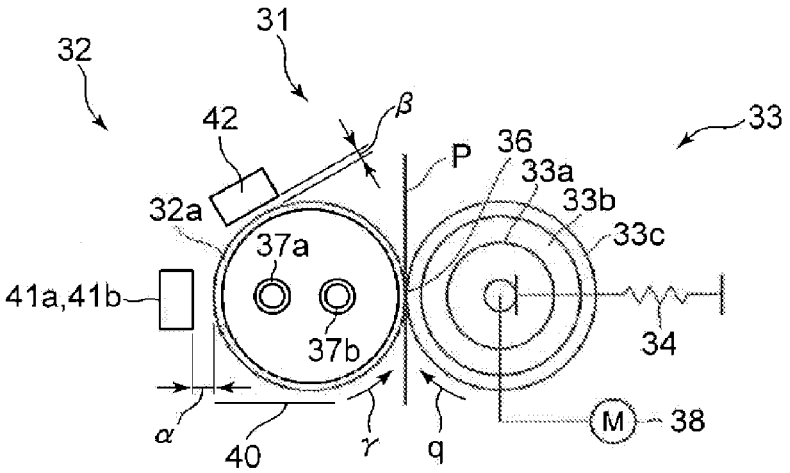
FIG. 2 is a schematic configuration diagram of the fuser unit viewed from a side.

The fuser unit 31 is explained in detail. As shown in FIG. 2, the fuser unit 31 includes a heat roller 32, which is a fixing rotating body configured to come into contact with the sheet P having the toner image, and a press roller 33, which is an opposed section. The fuser unit 31 nips and conveys the sheet P with a nip 36 formed between the heat roller 32 and the press roller 33 and heats and pressurizes the toner image to fix the toner image on the sheet P.

Figure 3:
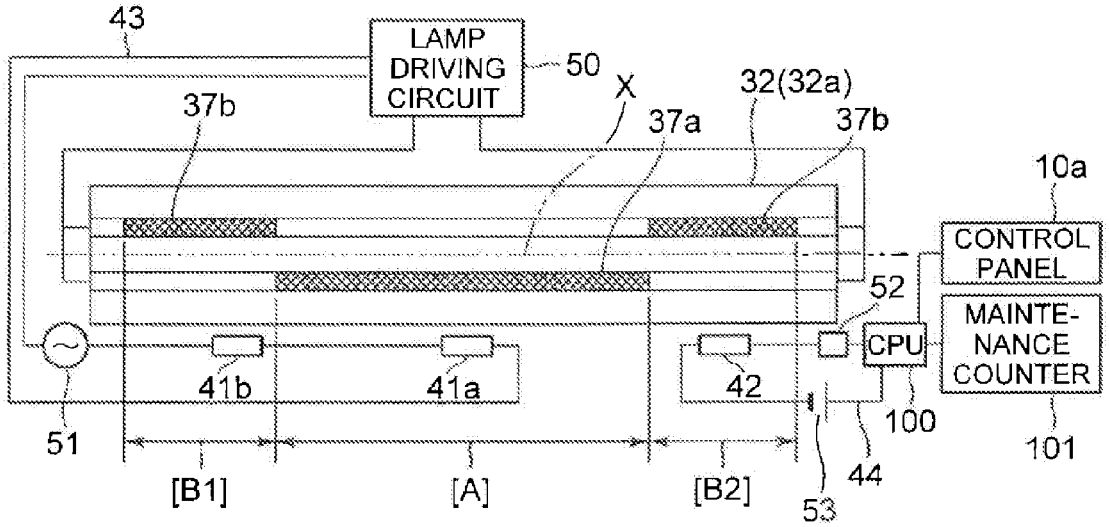
FIG. 3 is a schematic explanatory diagram of arrangement positions of a center thermostat, a side thermostat, and a second thermostat in the first embodiment and wires for the thermostats.

In the heat roller 32, for example, the surface of a cored bar 32*a*, which is a heat generating section, is sequentially coated with an elastic layer and a release layer. The heat roller 32 includes a first lamp 37*a* and second lamps 37*b*, which are heat generation sources, in a hollow inside. As shown in FIG. 3, for example, a light distribution area of the first lamp 37*a* is a center area [A] in a rotating axis X direction of the heat roller 32 and light distribution areas of the second lamps 37*b* are side areas [B1] and [B2] on both sides of the center area. The first lamp 37*a* and the second lamps 37*b* heat an area of the entire length in the rotating axis X direction of the heat roller 32.

In the press roller 33, for example, a silicon rubber layer 33*b* and a fluorocarbon rubber layer 33*c* are laminated around a cored bar 33*a*. A pressurizing mechanism 34 pressurizes the press roller 33 against the heat roller 32 to form the nip 36 between the heat roller 32 and the press roller 33. The fuser unit 31 includes a motor 38 that rotates the press roller 33 in an arrow q direction. The heat roller 32 rotates in an arrow r direction following the rotation of the press roller 33.

The fuser unit 31 includes, around the heat roller 32, a thermistor 40 configured to detect the temperature of the heat roller 32. The thermistor 40 is used for temperature control of the fuser unit 31. The fuser unit 31 includes, around the heat roller 32, a center thermostat 41*a* and aside thermostat 41*b*, which are first bimetal type thermostats. The fuser unit 31 includes, around the heat roller 32, a second thermostat 42, which is a second bimetal type thermostat. The center thermostat 41*a* and the side thermostat 41*b* are safety elements of the fuser unit 31. The second thermostat 42 is a new-old detecting element of the fuser unit 31.

The center thermostat 41*a* and the side thermostat 41*b* are connected to an alternating-current power supply 51 of a lamp driving circuit 50 in series. While the center thermostat 41*a* and the side thermostat 41*b* are connected, the lamp driving circuit 50 supplies electric power to the first lamp 37*a* and the second lamp 37*b*. If the center thermostat 41*a* or the side thermostat 41*b* is disconnected, the lamp driving circuit 50 stops the power supply to the first lamp 37*a* and the second lamp 37*b*. A rated voltage of the alternating-current power supply 51 is, for example, AC 200 V.

The second thermostat 42 is connected to a direct-current power supply 53 of a new-old detecting circuit 52 in series. While the second thermostat 42 is connected, the new-old detecting circuit 52 outputs an "unused" signal for informing the CPU 100 that the fuser unit 31 is new. According to the input of the "unused" signal, the CPU 100 determines that the fuser unit 31 is new.

If the second thermostat 42 is disconnected, the new-old detecting circuit 52 outputs an "old" signal for informing the CPU 100 that the fuser unit 31 is in use. According to the input of the "old" signal, the CPU 100 determines that the fuser unit 31 is already used.

If the output of the new-old detecting circuit 52 transitions from the "unused" signal to the "old" signal because the second thermostat 42 in a connected state is disconnected, the CPU 100 determines that the fuser unit 31 is replaced with a new unit. The CPU 100 resets a maintenance counter 101 of the fuser unit 31 according to the transition of the output signal of the new-old detecting circuit 52. A rated voltage of the direct-current power supply 53 is, for example, DC 5 V. The new-old detecting circuit 52 outputs a minute electric current of 1 mA as the "unused" signal.

The center thermostat 41*a* or the side thermostat 41*b* is disconnected by heating due to abnormal heat generation of the heat roller 32. The center thermostat 41*a* or the side thermostat 41*b* is disconnected when heated to, for example, 200° C. If the center thermostat 41*a* or the side thermostat 41*b* is disconnected, the lamp driving circuit 50 stops the power supply to the first lamp 37*a* and the second lamp 37*b*.

The second thermostat 42 is disconnected by heating due to first heat generation of the heat roller 32 after the new fuser unit 31 is mounted on the MFP 10. The second thermostat 42 is disconnected at temperature lower than the disconnecting temperature of the center thermostat 41*a* or the side thermostat 41*b*. The second thermostat 42 is disconnected when heated to, for example, 75° C. If the second thermostat 42 is disconnected, the CPU 100 resets the maintenance counter 101.

Set temperatures for disconnecting the center thermostat 41*a*, the side thermostat 41*b*, and the second thermostat 42 are not limited. The set temperature for disconnecting the center thermostat 41*a* and the side thermostat 41*b* only has to be temperature at which the power supply to the first lamp 37*a* and the second lamp 37*b* can be stopped before the fuser unit 31 and peripheral equipment are damaged by abnormal heat generation of the heat roller 32.

The set temperature for disconnecting the second thermostat 42 is set lower than the disconnecting temperature of the center thermostat 41*a* and the side thermostat 41*b*. It is possible to surely transition the output of the new-old detecting circuit 52 from the "unused" signal to the "old" signal by setting the disconnecting temperature of the second thermostat 42 low. However, the disconnecting temperature of the second thermostat 42 has to be set higher than a specification temperature in a transportation environment and a storage environment of the MFP 10. The disconnecting temperature of the second thermostat 42 needs to be set to, for example, 60° C. or higher.

The center thermostat 41*a* is opposed to the heat roller 32 in the center area [A]. The side thermostat 41*b* is opposed to the heat roller 32 in the side area [B1]. The second thermostat 42 is opposed to the side area [B2] opposite to the side area [B1] in the rotating axis X direction of the heat roller 32 across the center area [A].

In a rotating direction of the heat roller 32, the center and side thermostats 41*a* and 41*b* and the second thermostat 42 are present in different positions. For example, the center thermostat 41*a* and the side thermostat 41*b* are present further downstream than the second thermostat 42 in the rotating direction in the arrow r direction of the heat roller 32. In the rotating direction of the heat roller 32, the second thermostat 42 may be arranged further downstream than the center thermostat 41*a* and the side thermostat 41*b*.

The center and side thermostats 41*a* and 41*b* and the second thermostat 42 are separated both in the rotating axis X direction of the heat roller 32 and in the rotating direction in the arrow r direction of the heat roller 32. As shown in FIG. 3, around the heat roller 32, a wire 43 for connecting the center thermostat 41*a* and the side thermostat 41*b* to the alternating-current power supply 51 and a wire 44 for connecting the second thermostat 42 to the direct-current power supply 53 can be arranged to be separated from each other.

The center thermostat 41*a* and the side thermostat 41*b* have a gap $\alpha$, which is a first gap, between the center and side thermostats 41*a* and 41*b* and the heat roller 32. The second thermostat 42 has a gap $\beta$, which is a second gap, between the second thermostat 42 and the heat roller 32. A relation between the sizes of the gap $\alpha$ between the center and side thermostats 41*a* and 41*b* and the heat roller 32 and the gap $\beta$ between the second thermostat 42 and the heat roller 32 is $\alpha>\beta$. The second thermostat 42 is surely disconnected after the replacement of the fuser unit 31 by setting an arrangement position of the second thermostat 42 closer to the heat roller 32 than an arrangement position of the center thermostat 41*a* or the side thermostat 41*b*.

Figure 4:
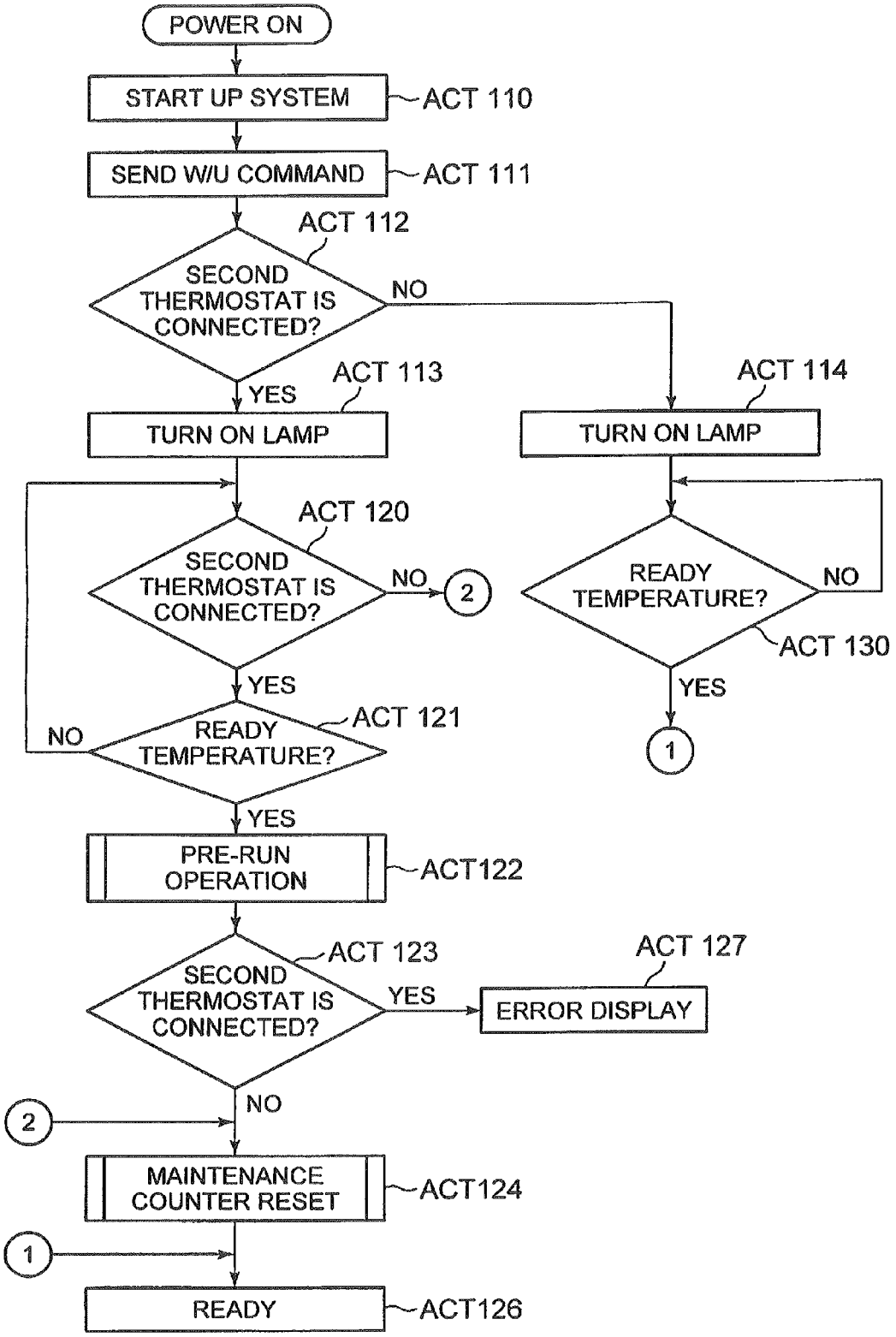
FIG. 4 is a flowchart for explaining a procedure for resetting a maintenance counter of the fuser unit.

A procedure for resetting the maintenance counter 101 for informing a replacement period for the fuser unit 31 replaced anew is explained with reference to a flowchart of FIG. 4. When the new fuser unit 31 is mounted and a power supply for the MFP 10 is turned on, the CPU 100 starts up a system (ACT 110), sends a warm-up command (ACT 111), and proceeds to ACT 112. In ACT 112, before turning on the first lamp 37*a* or the second lamp 37*b*, the CPU 100 determines whether the second thermostat 42 is connected or disconnected.

If the second thermostat 42 is connected and the new-old detecting circuit 52 outputs the "unused" signal (Yes in ACT 112), the CPU 100 determines that the fuser unit 31 is new and proceeds to ACT 113. In ACT 113, the CPU 100 turns on the first lamp 37*a* and the second lamp 37*b* and proceeds to ACT 120. If the second thermostat 42 is already disconnected and the new-old detecting circuit 52 outputs the "old" signal before the CPU 100 turns on the first lamp 37*a* or the second lamp 37*b* (No in ACT 112), the CPU 100 determines that the fuser unit 31 is not new but is already in use and proceeds to ACT 114. In ACT 114, the CPU 100 turns on the first lamp 37*a* and the second lamp 37*b* and proceeds to ACT 130.

In ACT 120, until the heat roller 32 reaches a ready temperature, the CPU 100 periodically determines whether the second thermostat 42 is connected or disconnected. If the heat roller 32 reaches the ready temperature (Yes in ACT 121) in a state in which the second thermostat 42 is connected (Yes in ACT 120), the CPU 100 pre-runs the heat roller 32 and the press roller 33 (ACT 122). In ACT 122, the CPU 100 drives the motor 38 to rotate the press roller 33 in the arrow q direction, rotates the heat roller 32 in the arrow r direction following the rotation of the press roller 33, and proceeds to ACT 123.

In ACT 123, the CPU 100 determines again whether the second thermostat 42 is connected. If the second thermostat 42 is disconnected (No in ACT 123) and a signal of the new-old detecting circuit 52 transitions from the "unused" signal to the "old" signal, the CPU 100 determines that the fuser unit 31 is replaced and resets the maintenance counter 101 (ACT 124).

After resetting the maintenance counter 101 (ACT 124), the MFP 10 displays "ready" on the control panel 10*a* and enables print (ACT 126). After being reset (ACT 124), the maintenance counter 101 is counted up every time print is performed by the MFP 10. If the maintenance counter 101 reaches a predefined value, the CPU 100 displays on the control panel 10*a* that, for example, the replacement period for the fuser unit 31 comes.

If the second thermostat 42 is disconnected (No in ACT 120) and the signal of the new-old detecting circuit 52 transitions from the "used" signal to the "old" signal while the CPU 100 periodically determines in Act 120 whether the second thermostat 42 is disconnected, the CPU 100 determines that the fuser unit 31 is replaced, proceeds to ACT 124, and resets the maintenance counter 101.

If the second thermostat 42 is kept connected (Yes in ACT 123) and the new-old detecting circuit 52 keeps on outputting the "old" signal, the CPU 100 determines that a deficiency occurs in the second thermostat 42 of the replaced fuser unit 31 and displays an error on the control panel 10*a* (ACT 127).

If the error display is performed (ACT 127), for example, a user replaces the fuser unit 31 mounted on the MFP 10 with another new fuser unit.

If the fuser unit 31 is not new but is already in use and the CPU 100 proceeds to ACT 130, the CPU 100 waits for the heat roller 32 to reach the ready temperature (Yes in ACT 130) and proceeds to ACT 126. If the heat roller 32 reaches the ready temperature (Yes in ACT 130), the CPU 100 skips the operation for resetting the maintenance counter 101 and enables to print.

According to the first embodiment, the center thermostat 41*a* and the side thermostat 41*b* of the bimetal type are used as the safety elements of the fuser unit 31. The second thermostat 42 of the bimetal type is used as the new-old detecting element of the fuser unit 31. It is unnecessary to provide a dedicated circuit for disconnecting the thermostats 41*a*, 41*b*, and 42. All of the safety elements and the new-old detecting element are unlikely to be connected again after being disconnected once.

According to the first embodiment, the center and side thermostats 41*a* and 41*b* and the second thermostat 42 are arranged to be separated from each other both in the rotation axis direction of the heat roller 32 and the rotating direction of the heat roller 32. The wire 43 of AC 200 V for the center thermostat 41*a* and the side thermostat 41*b* and the wire 44 of DC 5 V and 1 mA for the second thermostat 42 can be arranged to be separated from each other. A signal for safety maintenance and a signal for new-old detection do not affect each other. The second thermostat 42 is unlikely to be affected by an electric current of the wire 43 for the lamp driving circuit 50 and disconnected by mistake to reset the maintenance counter 101 by mistake. After the replacement of the fuser unit 31, the heat roller 32 is heated first, whereby the second thermostat 42 is surely disconnected to accurately reset the maintenance counter 101.

[Second Embodiment]

A second embodiment is explained. In the second embodiment, an induction heating coil (IH coil), which is an induction-current generating unit, is used as a heat generation source in the first embodiment. In the second embodiment, components same as the components explained in the first embodiment are denoted by the same reference numerals and signs and detailed explanation of the components is omitted.

Figure 5:
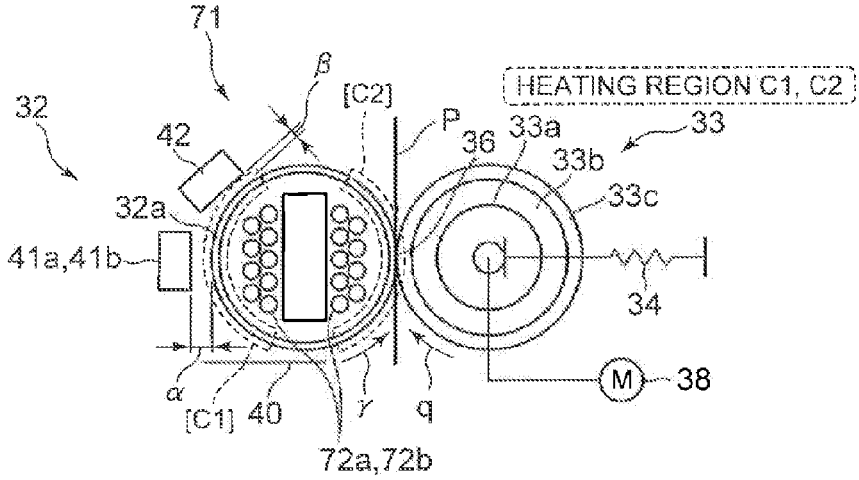
FIG. 5 is a schematic configuration diagram of a fuser unit in a second embodiment viewed from a side.

A fuser unit 71 in the second embodiment is shown in FIG. 5. The fuser unit 71 includes a first IH coil 72*a* and a second IH coil 72*b* in a hollow inside of the heat roller 32. Dotted lines C1 and C2 indicate heat generation regions where the cored bar 32*a* of the heat roller 32 generates heat by being excited by the first IH coil 72*a* and the second IH coil 72*b* in the rotating direction of the heat roller 32 (the arrow r direction). The second thermostat 42 is opposed to the heat generation region C1 of the heat roller 32. The second thermostat 42 may be opposed to the heat generation region C2 of the heat roller 32. The center thermostat 41*a* and the side thermostat 41*b* may be opposed to or not opposed to the heat generation regions C1 and C2 of the heat roller 32.

Figure 6:
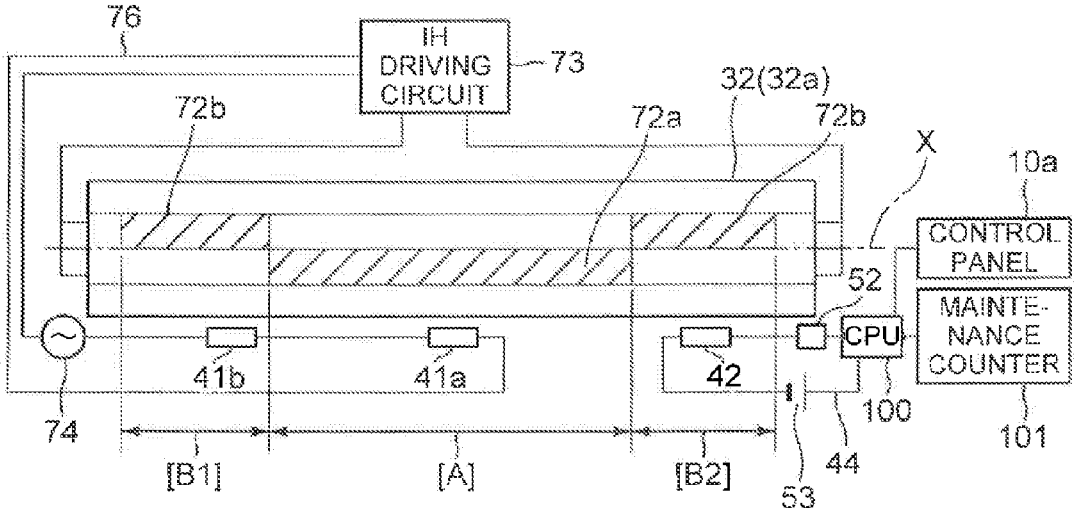
FIG. 6 is a schematic explanatory diagram of arrangement positions of a center thermostat, a side thermostat, and a second thermostat in the second embodiment and wires for the thermostats.

As shown in FIG. 6, the first IH coil 72*a* excites the cored bar 32*a* of the heat roller 32 in the center area [A] in the rotation axis X direction of the heat roller 32. The second IH coil 72*b* excites the cored bar 32*a* of the heat roller 32 in the side areas [B1] and [B2] on both the sides of the center area [A] in the rotating axis X direction of the heat roller 32.

The center thermostat 41*a* and the side thermostat 41*b* are connected to an alternating-current power supply 74 of an IH driving circuit 73 in series. If the center thermostat 41*a* or the side thermostat 41*b* is disconnected, the IH driving circuit 73 stops power supply to the first IH coil 72*a* and the second IH coil 72*b*. If the second thermostat 42 in a connected state is disconnected and an output of the new-old detecting circuit 52 transitions from the "unused" signal to the "old" signal, the CPU 100 determines that the fuser unit 71 is replaced.

The arrangement of the center and side thermostats 41*a* and 41*b* and the second thermostat 42 is the same as the arrangement in the first embodiment. The second thermostat 42 is separated from the center thermostat 41*a* and the side thermostat 41*b* in the rotation axis X direction of the heat roller 32. The second thermostat 42 is present upstream of the center thermostat 41*a* and the side thermostat 41*b* in the rotating direction of the heat roller 32 (the arrow r direction). Around the heat roller 32, a wire 76 for connecting the center thermostat 41*a* and the side thermostat 41*b* to the alternating-current power supply 74 and the wire 44 for connecting the second thermostat 42 to the direct-current power supply 53 can be arranged to be separated from each other.

A relation between the sizes of the gap a between the center and side thermostats 41*a* and 41*b* and the heat roller 32 and the gap β between the second thermostat 42 and the heat roller 32 is $\alpha>\beta$ as in the first embodiment. The second thermostat 42 is set close to the heat roller 32 and the first IH coil 72*a* and the second IH coil 72*b* are excited first after replacement of the fuser unit 71 to heat the heat roller 32. The heat roller 32 is heated, whereby the second thermostat 42 is surely disconnected.

A procedure for resetting the maintenance counter 101 for informing a replacement period of the fuser unit 71 replaced anew is the same as the procedure in the first embodiment. However, in the second embodiment, in ACT 113 and ACT 114 in FIG. 4, the first IH coil 72*a* and the second IH coil 72*b* are turned on instead of the first lamp 37*a* and the second lamp 37*b*.

In the second embodiment, as in the first embodiment, the center thermostat 41*a*, the side thermostat 41*b*, and the second thermostat 42 of the bimetal type are used. It is unnecessary to provide a dedicated circuit for disconnecting the thermostats 41*a*, 41*b*, and 42. All of the safety elements and the new-old detecting element are unlikely to be connected again after being disconnected once.

In the second embodiment, as in the first embodiment, the wire 76 for the center thermostat 41*a* and the side thermostat 41*b* and the wire 44 for the second thermostat 42 can be arranged to be separated from each other. The second thermostat 42 is unlikely to be affected by an electric current of the wire 76 for the IH driving circuit 73 and disconnected by mistake to reset the maintenance counter 101 by mistake. After the replacement of the fuser unit 71, the heat roller 32 is heated first, whereby the second thermostat 42 is disconnected to accurately reset the maintenance counter 101.

[Third Embodiment]

A third embodiment is explained. In the third embodiment, an IH coil is provided in the outer circumference of a heat roller as a heat generation source in the second embodiment. In the third embodiment, components same as the components explained in the second embodiment are denoted by the same reference numerals and signs and detailed explanation of the components is omitted.

Figure 7:
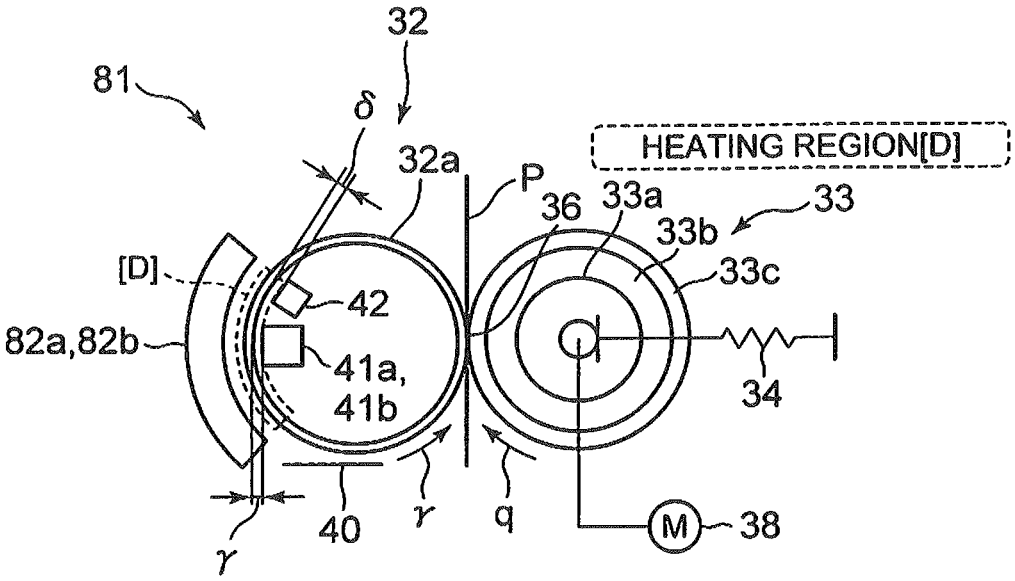
FIG. 7 is a schematic diagram of a fuser unit in a third embodiment viewed from a side.

A fuser unit 81 in the third embodiment is shown in FIG. 7. The fuser unit 81 includes a first IH coil 82*a* and a second IH coil 82*b* in the outer circumference of the heat roller 32. The arrangement of the first IH coil 82*a* and the second IH coil 82*b* in the rotation axis X direction of the heat roller 32 is the same as the arrangement of the first IH coil 72*a* and the second IH coil 72*b* in the second embodiment. The first IH coil 82*a* excites the cored bar 32*a* of the heat roller 32 in the center area [A] in the rotation axis X direction of the heat roller 32. The second IH coil 82*b* excites the cored bar 32*a* of the heat roller 32 in the side areas [B1] and [B2] on both the sides of the center area [A] of the heat roller 32.

A dotted line D in FIG. 7 indicates a heat generation region where the cored bar 32*a* of the heat roller 32 generates heat by being excited by the first IH coil 82*a* and the second IH coil 82*b* in the rotating direction of the heat roller 32 (the arrow r direction). The center thermostat 41*a*, the side thermostat 41*b*, and the second thermostat 42 are opposed to the heat generation region D in the hollow inside of the heat roller 32.

The center thermostat 41*a* and the side thermostat 41*b* are heated by heat generation of the heat roller 32 by an induction current of the first IH coil 82*a* and the second IH coil 82*b*. The center thermostat 41*a* and the side thermostat 41*b* are disconnected when heated to 200° C. by heat conduction due to the heat generation of the heat roller 32.

The second thermostat 42 is heated by self-heat generation due to the induction current of the first IH coil 82*a* and the second IH coil 82*b*. The second thermostat 42 is disconnected when heated to 75° C. by the self-heat generation due to the induction current.

As in the second embodiment, if the center thermostat 41*a* or the side thermostat 41*b* are disconnected, the power supply to the first IH coil 82*a* and the second IH coil 82*b* is stopped. If the second thermostat 42 in a connected state is disconnected and an output of the new-old detecting circuit 52 transitions from the "unused" signal to the "old" signal, the CPU 100 determines that the fuser unit 81 is replaced.

The second thermostat 42 is arranged to be separated from the center thermostat 41*a* and the side thermostat 41*b* in the rotation axis X direction of the heat roller 32. The second thermostat 42 is present upstream of the center thermostat 41*a* and the side thermostat 41*b* in the rotating direction of the heat roller 32 (the arrow r direction).

As in the second embodiment, around the heat roller 32, a wire for the center thermostat 41*a* and the side thermostat 41*b* and a wire for the second thermostat 42 can be arranged to be separated from each other.

A relation between the sizes of a gap γ between the center and side thermostats 41*a* and 41*b* and the inner circumference of the heat roller 32 and a gap δ between the second thermostat 42 and the inner circumference of the heat roller 32 is $\gamma>\delta$. The second thermostat 42 is surely disconnected after the replacement of the fuser unit 81 by setting the second thermostat 42 close to the heat roller 32.

Figure 8:
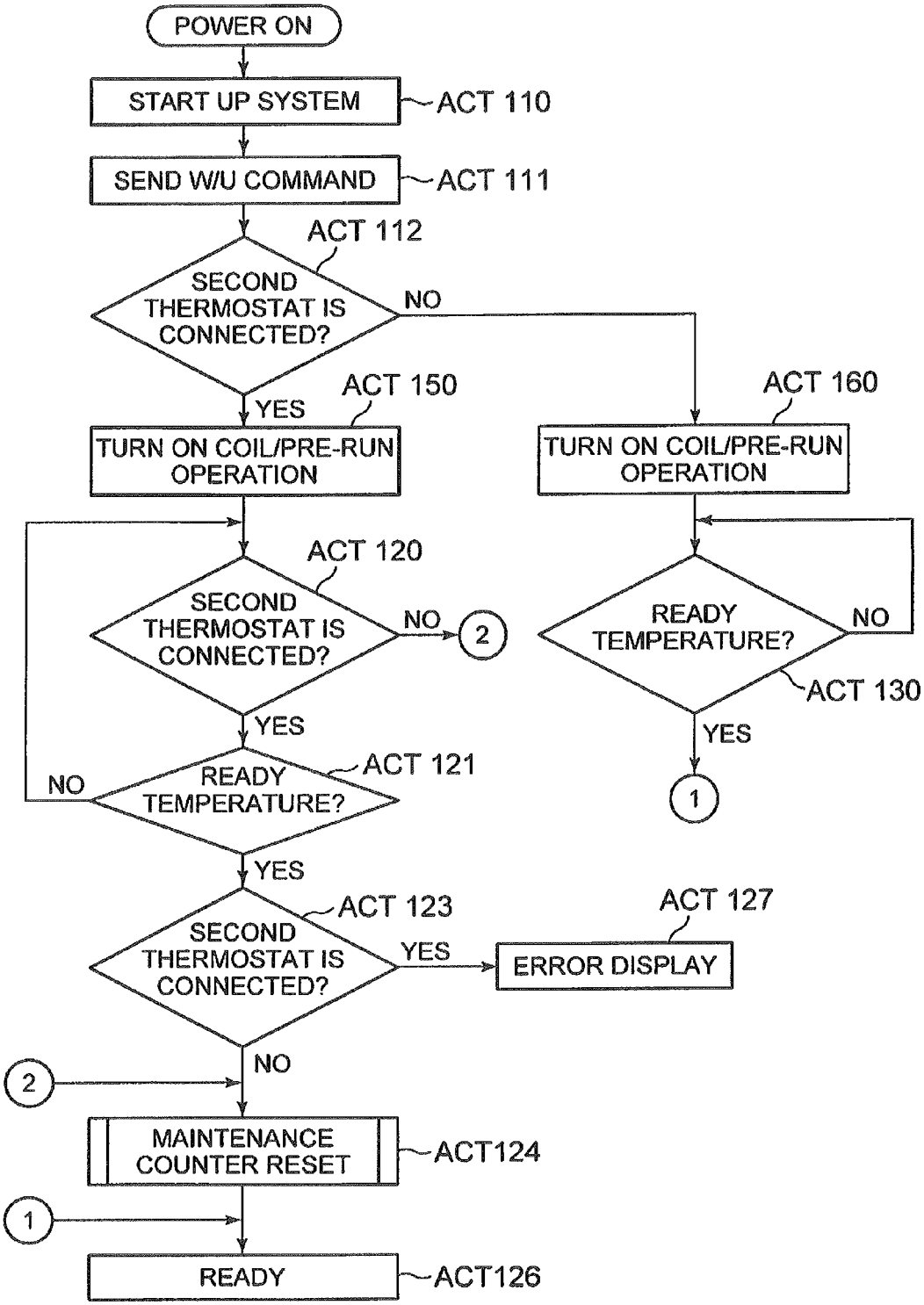
FIG. 8 is a flowchart for explaining a procedure for resetting a maintenance counter of the fuser unit.

A procedure for resetting the maintenance counter 101 for informing a replacement period of the fuser unit 81 replaced anew is explained with reference to a flowchart of FIG. 8. In the third embodiment, from power-on to ACT 112, the CPU 100 carries out a procedure same as the procedure in the first embodiment.

If the second thermostat 42 is connected and the new-old detecting circuit 52 outputs the "unused" signal (Yes in ACT 112), the CPU 100 determines that the fuser unit 81 is new and proceeds to ACT 150. Before the CPU 100 starts induction heating of the first IH coil 82*a* and the second IH coil 82*b*, if the second thermostat 42 is already disconnected and the new-old detecting circuit 52 outputs the "old" signal (No in ACT 112), the CPU 100 determines that the fuser unit 81 is not new but is already in use and proceeds to ACT 160.

In the third embodiment, the first IH coil 82*a* and the second IH coil 82*b* are arranged in the outer circumference of the heat roller 32. Therefore, in each of ACT 150 and ACT 160, the CPU 100 turns on the first IH coil 82*a* and the second IH coil 82*b* and pre-runs the heat roller 32 and the press roller 33. In each of ACT 150 and ACT 160, the CPU 100 drives the motor 38 to rotate the press roller 33 in the arrow q direction and rotate the heat roller 32 in the arrow r direction following the rotation of the press roller 33.

After carrying out ACT 150, the CPU 100 carries out ACT 120 and ACT 121 of a procedure same as the procedure in the first embodiment. If the heat roller 32 reaches the ready temperature in a state in which the second thermostat 42 is connected (Yes in ACT 121), since the heat roller 32 and the press roller 33 are already pre-run, the CPU 100 proceeds to ACT 123. In the third embodiment, the CPU 100 carries out ACT 123, ACT 124, ACT 126, and ACT 127 of the procedure same as the procedure in the first embodiment. After carrying out ACT 160, the CPU 100 carries out ACT 130 of the procedure same as the procedure in the first embodiment.

In the third embodiment, as in the second embodiment, the center thermostat 41*a*, the side thermostat 41*b*, and the second thermostat 42 of the bimetal type are used. It is unnecessary to provide a dedicated circuit for disconnecting the thermostats 41*a*, 41*b*, and 42. All of the safety elements and the new-old detecting element are unlikely to be connected again after being disconnected once. In the third embodiment, as in the first embodiment, the wire 76 for the center thermostat 41*a* and the side thermostat 41*b* and the wire 44 for the second thermostat 42 are arranged to be separated from each other.

In the third embodiment, the second thermostat 42 generates heat by itself with an induction current of the first IH coil 82*a* and the second IH coil 82*b*. After the fuser unit 81 is replaced, the first IH coil 82*a* and the second IH coil 82*b* are excited first, whereby the second thermostat 42 is quickly and surely disconnected to accurately reset the maintenance counter 101.

Figure 9:
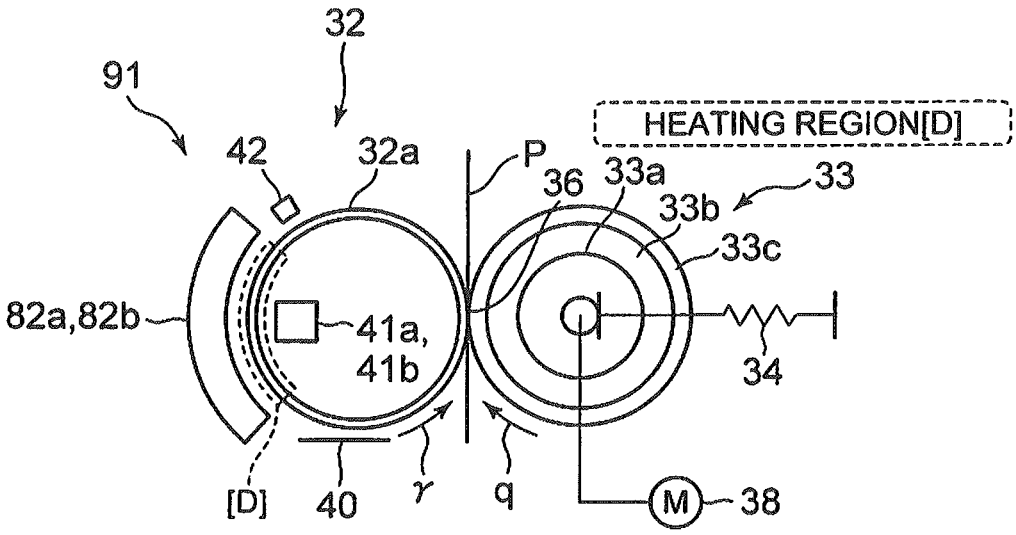
FIG. 9 is a schematic configuration diagram of a fuser unit in a modification viewed from a side.

In the third embodiment, an arrangement position of the second thermostat 42 is not limited. The second thermostat 42 may be arranged, for example, as in a modification shown in FIG. 9. In a fuser unit 91 in the modification, the center thermostat 41*a* and the side thermostat 41*b* are arranged in the inner circumference of the heat roller 32 and the second thermostat 42 is arranged in the outer circumference of the heat roller 32. Around the heat roller 32, a wire for the center thermostat 41*a* and the side thermostat 41*b* and a wire for the second thermostat 42 can be arranged to be more surely separated from each other.

In the modification, the second thermostat 42 is arranged in the outer circumference of the heat roller 32. Therefore, the second thermostat 42 does not generate heat by itself with the induction current of the first IH coil 82*a* and the second IH coil 82*b*. After the fuser user 81 is replaced, the first IH coil 82*a* and the second IH coil 82*b* are excited first to heat the heat roller 32, whereby the second thermostat 42 is disconnected.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and their equivalents are intended to cover such forms of modifications as would fall within the scope and spirit of the invention.

What is claimed is:

1. A fuser comprising:

a fixing rotating section including a heat generating section;

an opposed section configured to form a nip between the opposed section and the fixing rotating section;

an induction-current generating section disposed outside the fixing rotating section and configured to generate an induction current in the heat generating section;

a first bimetal type thermostat configured to be disconnected by heat from the fixing rotating section to cut off power supplied to the induction-current generating section; and a second bimetal type thermostat configured to be disconnected by heat generated therein by the induction-current generating section, in response to which an indication that the fixing rotating section is in use is output.

2. The fuser according to claim 1, wherein the first bimetal type thermostat is disconnected if the first bimetal type thermostat reaches a first temperature, and the second bimetal type thermostat is disconnected if the second bimetal type thermostat reaches a second temperature lower than the first temperature.

3. The fuser according to claim 1, wherein the second bimetal type thermostat is disposed along one end portion of the fixing rotating section away from the first bimetal type thermostat in a rotation axis direction of the fixing rotating section.

4. The fuser according to claim 1, wherein the first bimetal type thermostat and the fixing rotating section has a first gap, and the second bimetal type thermostat and the fixing rotating section has a second gap narrower than the first gap.

5. The fuser according to claim 1, wherein the second bimetal type thermostat is opposed to a heat generation region of the heat generating section.

6. An image forming apparatus comprising:

an image forming section configured to form an image on a recording medium;

a fixing rotating section including a heat generating section and configured to fix the image on the recording medium;

an opposed section configured to form a nip between the opposed section and the fixing rotating section and nip and convey the recording medium;

an induction-current generating section disposed outside the fixing rotating section and configured to generate an induction current in the heat generating section;

a first bimetal type thermostat configured to be disconnected by heat from the fixing rotating section to cut off power supplied to the induction-current generating section;

a second bimetal type thermostat configured to be disconnected by heat generated therein by the induction-current generating section, in response to which an indication that the fixing rotating section is in use is output; and a control section configured to reset a maintenance counter if the second bimetal type thermostat in a connected state is disconnected.

7. The apparatus according to claim 6, wherein the first bimetal type thermostat is disconnected if the first bimetal type thermostat reaches a first temperature, and the second bimetal type thermostat is disconnected if the second bimetal type thermostat reaches a second temperature lower than the first temperature.

* * * * *